US006637078B2

(12) United States Patent
Nagata et al.

(10) Patent No.: US 6,637,078 B2
(45) Date of Patent: Oct. 28, 2003

(54) SLIDER FOR SLIDE FASTENER WITH LOCKING DEVICE

(75) Inventors: Kazuo Nagata, Toyama-ken (JP); Koji Yamagishi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/119,834

(22) Filed: Apr. 11, 2002

(65) Prior Publication Data

US 2002/0152591 A1 Oct. 24, 2002

(30) Foreign Application Priority Data

Apr. 23, 2001 (JP) ..... 2001-124626

(51) Int. Cl.[7] ..... A44B 19/30

(52) U.S. Cl. ..... 24/421; 24/419; 24/424; 24/425; 24/429; 70/68

(58) Field of Search ..... 24/421, 419, 424, 24/429, 426, 420, 437, 425, 422; 70/68; 294/3.6

(56) References Cited

U.S. PATENT DOCUMENTS 4,074,399 A * 2/1978 Kedzierski ..... 24/421
4,768,263 A * 9/1988 Fukuroi et al. ..... 24/419
5,896,628 A * 4/1999 Oda ..... 24/421

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

It relates to a slider for slider fastener with locking device where a sheet-like spring having a locking pawl at one end is fixed at the other end on a body. A bent portion of a spring portion of the fixed spring is exposed at a guide post, and a pull is mounted between the body and the spring so as to be raised or laid. A cam is provided on a lower face of an axle of the pull, and the axle slides on an inclined guide portion on the body. When the pull is laid forward of the body, a gap is formed between an edge of a through hole of a grip portion of the pull and the bent portion of the spring. Even if a load is applied to the pull in the horizontal direction or the vertical direction, this gap prevents the spring from plastic deformation, so that the spring is never plastically deformed under any use condition, thereby ensuring an excellent locking function.

4 Claims, 10 Drawing Sheets

SLIDER FOR SLIDE FASTENER WITH LOCKING DEVICE

BACKGROUND OF THE INVENTION

1. Field of the Invention

The present invention relates to a slider having a locking mechanism for use in a slide fastener, and more particularly to a slider for slide fastener with locking device, in which a sheet-like spring having a locking pawl is elastically deformed by raising or laying operation of its pull so as to engage the locking pawl with a fastener-element row, thereby activating locking function.

2. Description of the Related Art

Conventionally, a slide fastener is mounted to an opening of clothes of every kind, and the opening is opened or closed by separating or meshing its fastener-element rows by means of a sliding operation of a slider. Further, in order to protect the fastener-element rows from being separated without necessity, it has been known to use a slider having a locking device.

As a slider for slide fastener with locking device, for example, a slider shown in FIG. 11 has been known. The slider is comprised of a body 1', a sheet-like spring 2' and a pull 3'. In the body 1', one-side ends of an upper wing plate and a lower wing plate, which are disposed in parallel, are connected by a guide post 7' so as to form an element guide groove 13' between the both wing plates. The aforementioned sheet-like spring 2' is mounted on a top face of the upper wing plate and is provided at one end thereof with a locking pawl 25', which is adapted to project into the element guide groove 13' through a pawl hole formed in the upper wing plate while it is provided at the other end with a spring portion which is adapted to be fixed in an accommodation groove formed at a front face of the guide post 7'. Further, the pull 3' is provided at one end thereof with a grip portion 38' which can be gripped with fingers while it is provided at the other end with an axle having a cam 39' disposed between the body 1' and the sheet-like spring 2'.

Elastic force is always applied to the axle of the pull 3', thereby making it possible to keep the pull 3' laid. Further, when the pull 3' is raised to rotate the axle, the axle deforms the sheet-like spring 2' elastically and pushes it up, so that the locking pawl 25' can be retracted from the element guide groove 13'.

Particularly, the above-described slider for the slide fastener having the locking device is mounted on a slide fastener sewed to trousers or skirt made of jeans.

Because the jeans fabric is hard and, mechanical impact is applied to the clothes so as to improve its flexibility, feeling to the touch or the like, in order to overcome such a problem that the clothes made of jeans fabric gives an uncomfortable feeling to a wearer as it is. For example, a so-called stone wash operation is carried out, in which a stone of an appropriate size is thrown into a rotation drum together with the clothes to which the aforementioned slide fastener is sewed and then the clothes is struck by the stone when the rotation drum is rotated, or in which the clothes is thrown into a rotation drum provided with a multiplicity of protrusions on an inner periphery thereof and then the clothes is struck by the protrusions in accordance with the rotation of the rotation drum.

After the aforementioned slide fastener is sewed onto clothes such as trousers and skirt, usually the pull 3' is laid to the side of a front end of the body 1' so that most part of the pull 3' is protruded from the front end of the body 1' as shown in FIG. 11. If mechanical impact is applied under this condition, a load is applied to the pull 3' in a horizontal direction, namely a direction of pressing the pull 3' toward the axle, or in a vertical direction, namely a direction of pressing down the grip portion 38' of the pull 3'. Because at this time, the axle of the pull 3' raises the locking pawl 25' and at the same time the grip portion 38' of the pull 3' comes into contact with a bent portion 31' of the sheet-like spring 2' to press it excessively, plastic deformation is generated in the sheet-like spring 2'. If this state is induced, there occurs such a problem that even if it is intended to lay the pull 3' to the side of the rear end of the body 1' so as to activate the locking function, the locking function may not be activated because the locking pawl 25' remains retreated from the element guide groove 13'. This problem can occur not only when the aforementioned stone wash operation is carried out, but also when clothes is washed with a washing machine with its pull being laid to the side of the front end of the body at home.

SUMMARY OF THE INVENTION

The present invention has been achieved in views of the above-described problems and a point of the present invention is to improve a sheet-like spring so as not to induce plastic deformation. According to a slider with a locking device of the present invention, plastic deformation of the sheet-like spring is prevented even if a load is applied to the pull in a horizontal direction or a vertical direction when the pull is laid to the side of a front end of a body of the. Thus, even if the slider is employed in jeans and the jeans is washed or handled roughly at home, the slider is free from being damaged so that it can exert its locking function accurately for a long period. Further, the present invention provides the slider for slide fastener with locking device with a simple structure and an excellent function.

Furthermore, in the slider with locking device having a locking mechanism in which the sheet-like spring comprises a bent portion bent in the same direction as a locking pawl, even if a load in the horizontal direction or in the vertical direction is applied to the pull when the pull is laid to the side of the front end of the body, no plastic deformation is induced in the bent portion of the sheet-like spring, so that it is capable of exerting its locking function accurately. Further, because the bent portion is capable of being elastically deformed sufficiently when the load is applied, it is possible to provide a slider for slide fastener with locking device in which its locking device is free from being damaged for a long period.

Still further, because in the slider with locking device, the pull is formed in an appropriate shape for protecting the sheet-like spring having the locking pawl from being plastically deformed, an excellent locking function can be exerted for a long period.

Still further, by restricting a range of a rising action of the sheet-like spring having the locking pawl, which is generated when the pull is laid to the side of the front end of the body and pressurized, the sheet-like spring can be prevented securely from being plastically deformed.

BRIEF DESCRIPTON OF THE DRAWINGS

DESCRITPTION OF EMBODIMENTS

Figure 1:
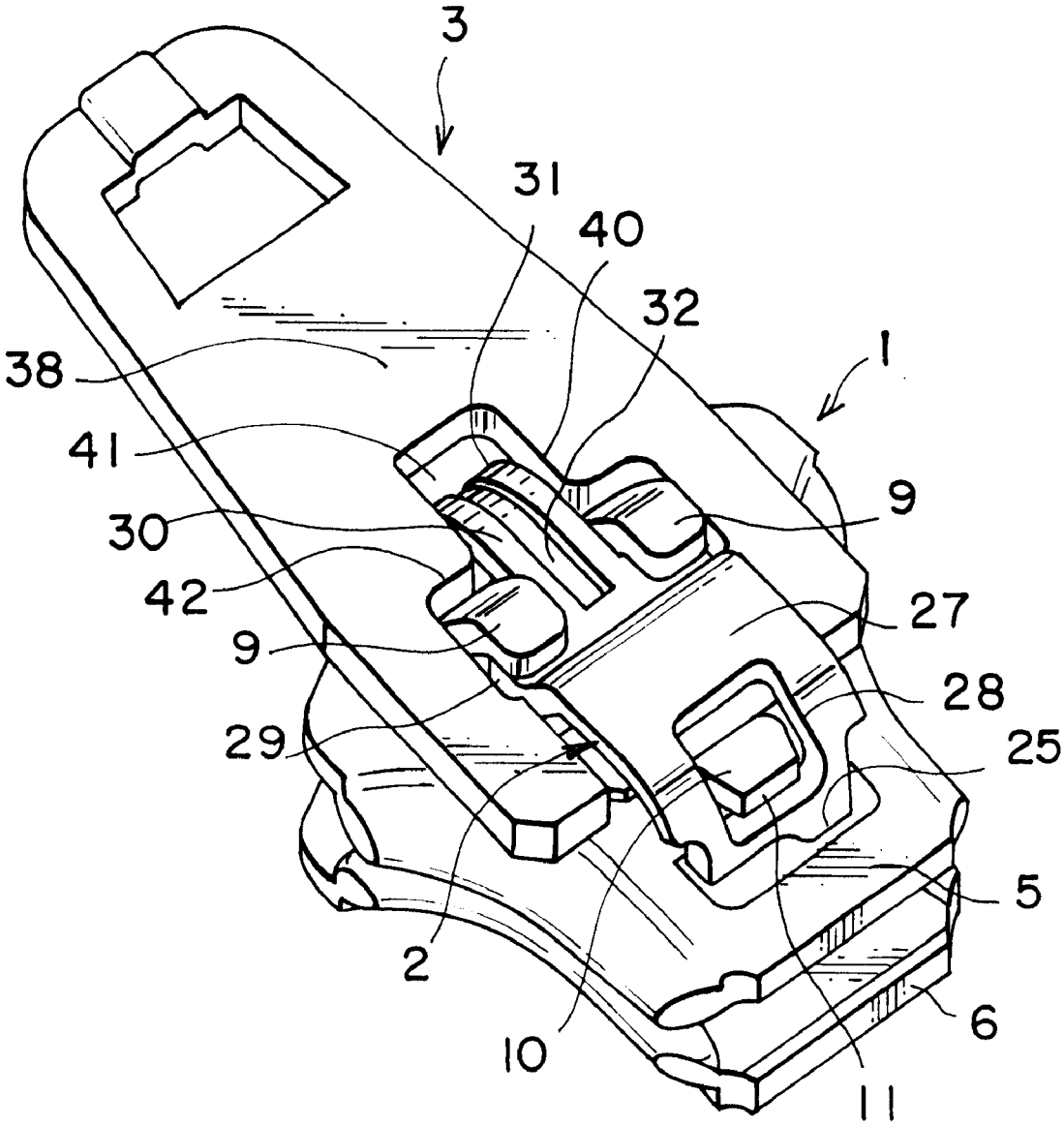
FIG. 1 is a perspective view of a slider for slide fastener with locking device.
Figure 2:
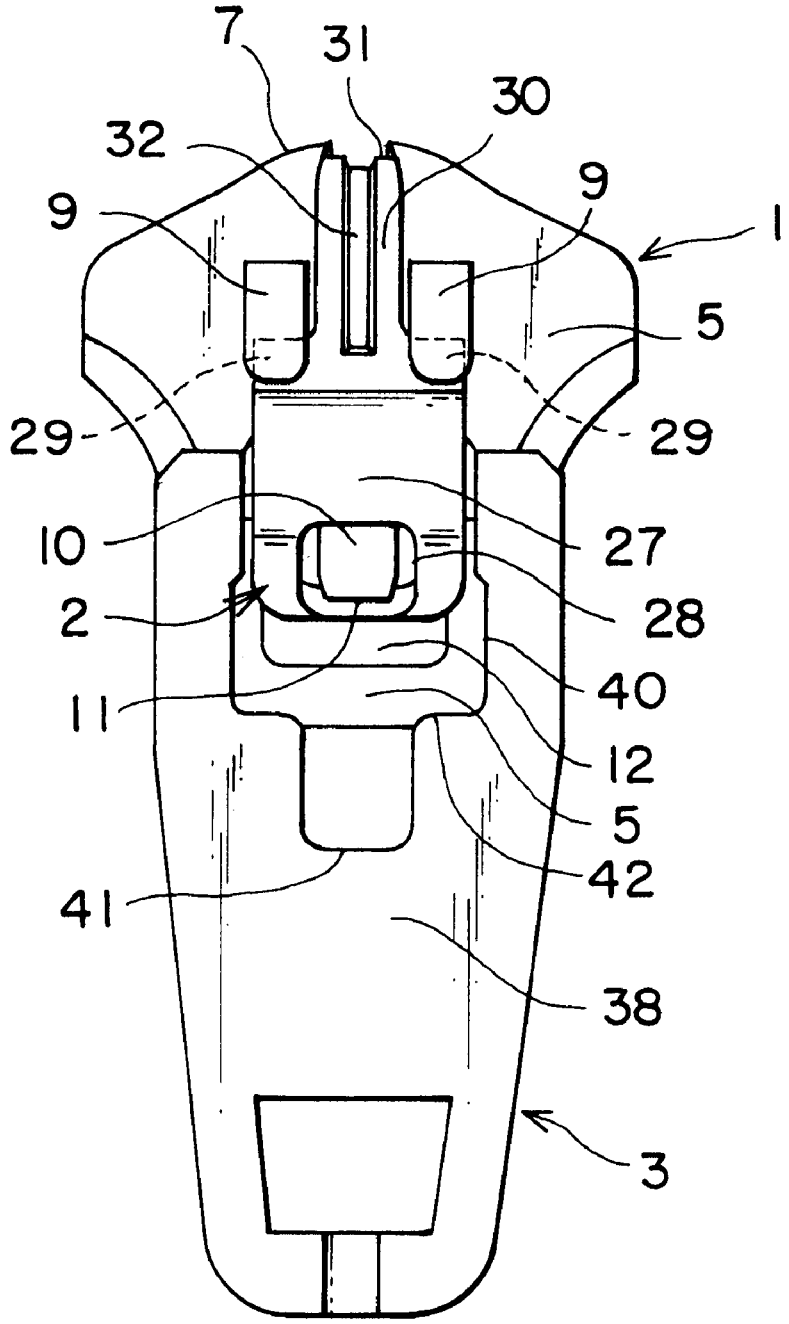
FIG. 2 is a front view showing a state in which a pull of the slider is laid backward.
Figure 3:
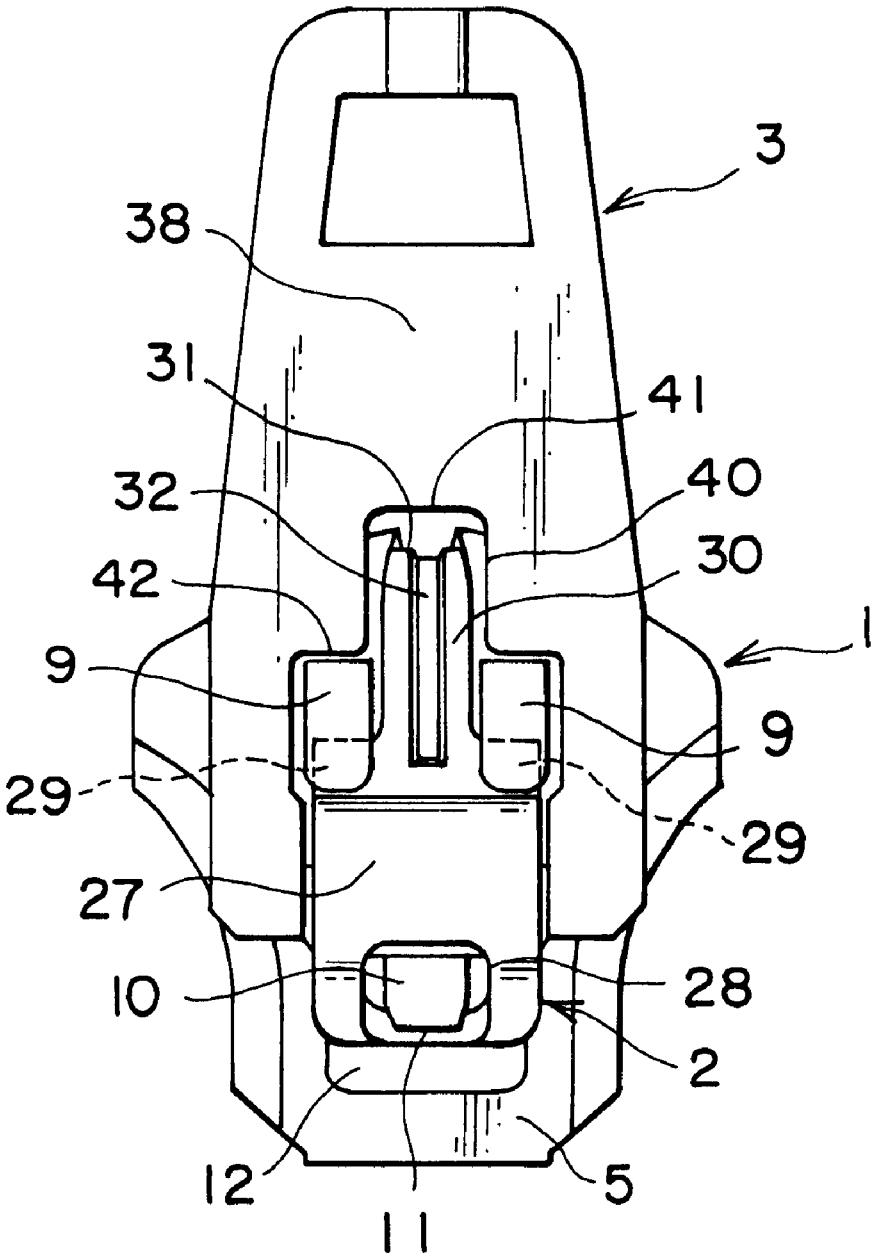
FIG. 3 is a front view showing a state in which the pull of the slider is laid forward.

Hereinafter, embodiments of a slider for slide fastener with locking device of the present invention will be described with reference to the accompanying drawings.

The slider for slide fastener with locking device of the present invention is an ordinary type slider having a locking mechanism as shown in FIGS. 1 to 4 and is a sturdy one to be used for jeans. The slider is comprised of three members, namely a body 1, a sheet-like spring 2 and a pull 3, and these respective members are manufactured by processing metal such as copper-zinc alloy with pressing means.

The body 1 of the slider is formed of an upper wing plate 5, a lower wing plate 6 and a guide post 7 for connecting the upper wing plate 5 and the lower wing plate 6. A pair of hook-like spring-receiving portions 9, which are laterally arranged, are provided so as to protrude near a shoulder or a front end of the upper wing plate 5 in order to support protruded portions 29 of the sheet-like spring 2. A guide portion 10 is provided so as to protrude near a rear opening or a rear end of the upper wing plate 5 such that it is inclined toward the rear opening or the rear end in order to guide an axle 37 of the pull 3. A front end of the guide portion 10 is bent toward the rear opening to form an engaging portion 11 for engaging with an engaging hole 28 provided in the sheet-like spring 2. Further, a pawl hole 12 is formed at a base portion behind the guide portion 10 for insertion of a locking pawl 25 such that the locking pawl 25 can invade into or retreat from an element guide groove 13 freely. Furthermore, an accommodation groove 14 having a V-shaped or U-shaped section is provided at a front face of the guide post 7 such that it can accommodate a drooping portion 26 of a spring portion 30 of the sheet-like spring 2.

The sheet-like spring 2 is formed in substantially inverted U shape and it has the locking pawl 25 at one end thereof while having a narrow drooping portion 26 at the other end thereof. A wide base plate 27 is provided a middle of the sheet-like spring 2. The base plate 27 is formed so as to be protruded upward so that the axle 37 having a cam 39 of the pull 3 can be accommodated therein. A part extending from the base plate 27 up to the locking pawl 25 is gently bent, where the engaging hole 28, which is capable of loosely engaging with the engaging portion 11 of the guide portion 10 formed on the upper wing plate 5, is provided. A front end of the base plate 27 is formed horizontally and both ends thereof are cut out to form protruded portions 29. The protruded portions 29 are formed so as to be capable of engaging the spring-receiving portions 9 protruded from the upper wing plate 5. The narrow spring portion 30 is extended forward from a middle of the right/left protruded portions 29 provided on the base plate 27 and is bent at a middle portion thereof so as to form a bent portion 31. The drooping portion 26 is formed ahead of the bent portion 31 and held in the accommodation groove 14 provided in the guide post 7 of the body 1. In addition, a dent groove 32 is provided in a center of the spring portion 30 so as to intensify its elasticity.

The pull 3 is formed of a substantially rectangular plate. The axle 37 is provided at an end of the pull 3 while a grip portion 38 is provided at the other end thereof with a gap from the axle 37. The cam 39 is formed integrally on a bottom side of the axle 37 such that it is protruded downward. When the pull 3 is mounted on the body 1 and is laid to the side of the shoulder or the front end, the base plate 27 of the sheet-like spring 2 is pushed up so that the locking pawl 25 is raised from the element guide groove 13. Further, an inverted-T shaped through hole 40, in which the side of the pull 3 toward the axle 37 is expanded, is provided between the axle 37 and the grip portion 38. Furthermore, a concave portion 41 formed in the center of the through hole 40 such that it is capable of avoiding the bent portion 31 of the sheet-like spring 2 placed on a top face of the guide post 7 of the body 1 when the pull 3 is laid to the side of the front end of the body 1. Further, even when the pull 3 is laid to the side of the front end of the body 1 so that a load in the horizontal direction or the vertical direction is applied to the pull 3, the concave portion 41 does not contact the bent portion 31 of the sheet-like spring 2 and a gap is formed between the grip portion 38 and the bent portion 31. Furthermore, when a load is applied to the pull 3, extended portions 42 extended on both sides of the concave portion 41 can come into contact with base portions of the spring-receiving portions 9 protruded from the top face of the upper wing plate 5, so as to receive the load applied to the pull 3.

Next, assembly of the slider having the locking mechanism will be described. The axle 37 having the cam 39 of the pull 3 is placed between the spring-receiving portions 9 and the guide portion 10 protruded on the top face of the upper wing plate 5 of the body 1. At this time, the axle 37 is placed such that the cam 39 of the pull 3 is directed downward and the pull 3 is laid toward the rear opening or the rear end of the body 1. Then, the sheet-like spring 2 is disposed on a top face thereof. At this time, the protruded portions 29 are disposed under the spring-receiving portions 9 such that the base plate 27 of the sheet-like spring 2 covers the axle 37, while the engaging hole 28 in the sheet-like spring 2 holds the engaging portion 11 of the distal end of the guide portion 10 and then, the drooping portion 26 of the spring portion 30 is inserted into the accommodation groove 14 formed at the front face of the guide post 7 of the body 1 and fixed thereto.

Figure 4:
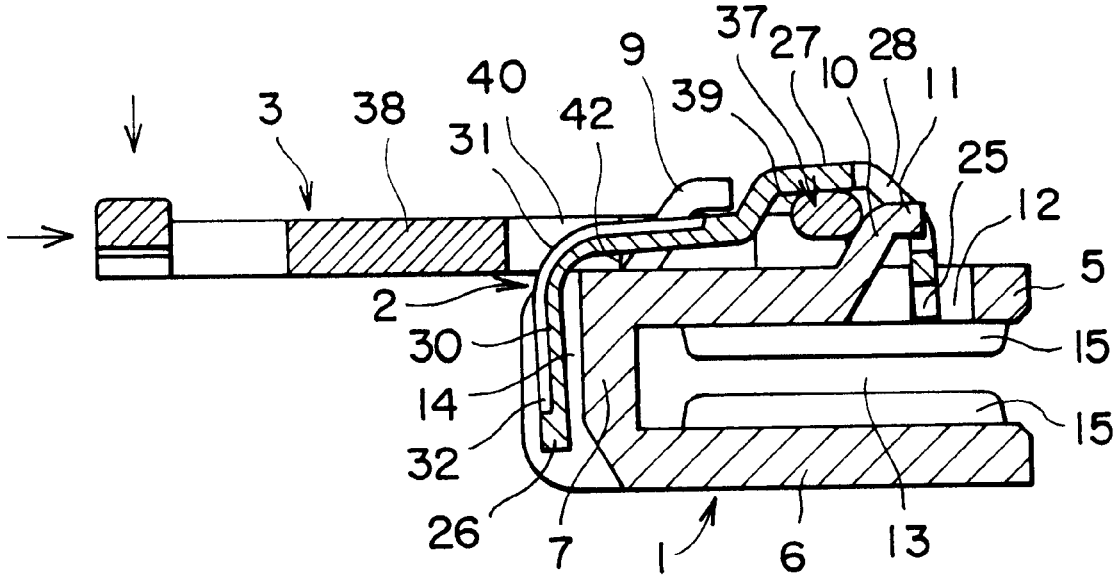
FIG. 4 is a longitudinal sectional view showing a state in which the pull of the slider is laid forward and the load is applied.
Figure 5:
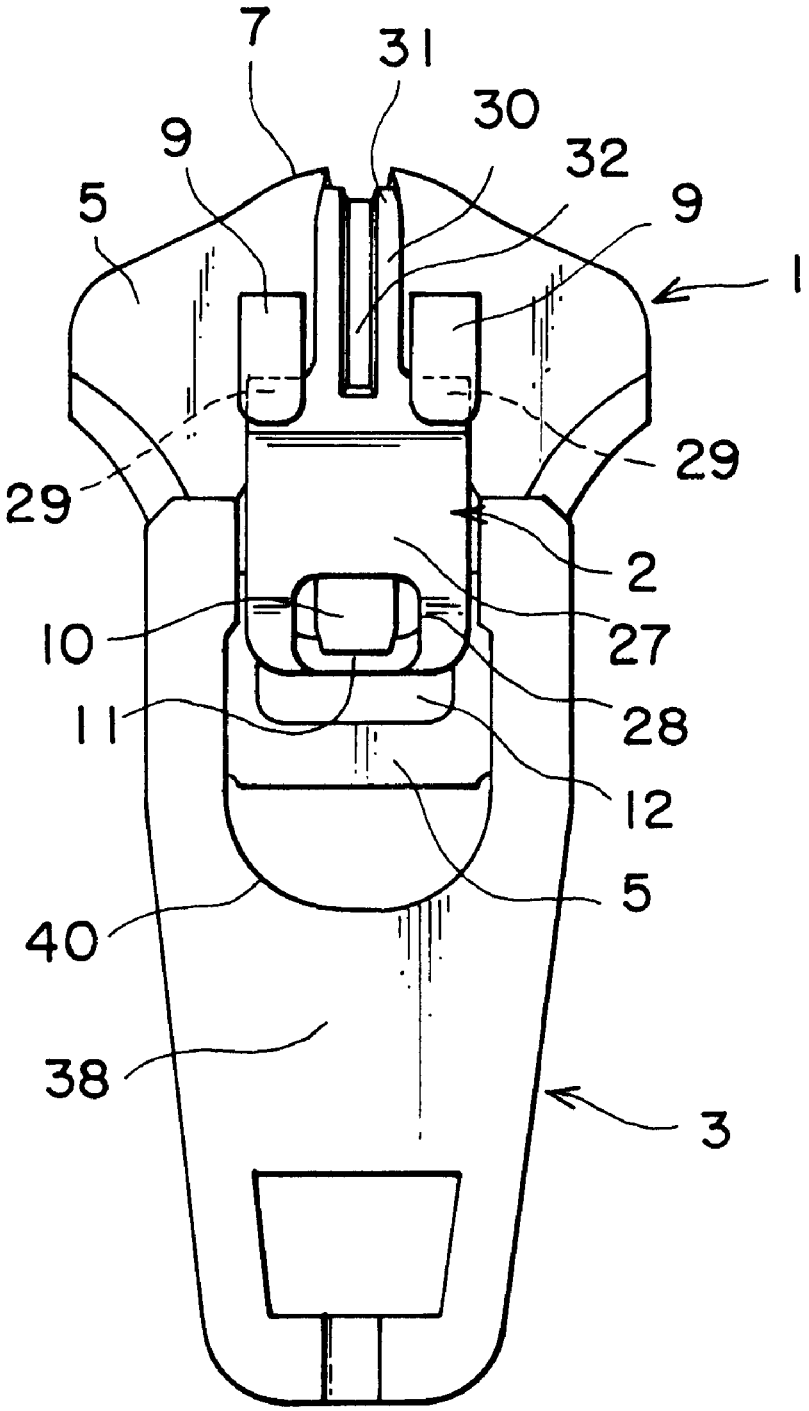
FIG. 5 is a front view of a modified example of the slider with locking device having a pull showing a state in which the pull is laid backward.

Further, it is permissible to fix the drooping portion 26 by crimping both sides of the accommodating groove 14 or it is permissible to provide a front end of the drooping portion 26 with protrusions protruded to the both sides and then engage them with concave portions incised in the both sides of the accommodating groove 14. The locking pawl 25 of the sheet-like spring 2 fixed to the guide post 7 is always protruded into the element guide groove 13 in the body 1 such that it can invade into or retreat from the element guide groove 13 freely by the operation of the pull 3. The assembled slider having the locking mechanism is mounted to a fastener chain. When with the pull 3 laid forward, the slider is pulled, the fastener chain is closed. When the slider is pulled with the pull 3 laid backward, the fastener is opened. The feature of the slider of the present invention is in solving such a problem that not when the pull 3 is laid to the side of the rear end of the body 1 but when it is laid to the side of the front end of the body 1 as shown in FIG. 4, a load is applied to the pull 3 in the horizontal direction or the vertical direction, and even if the axle 37 of the pull 3 is moved upward toward the guide portion 10 trying to push up the sheet-like spring 2, the expanded portions 42 of the pull 3 come into contact with the base portions of the spring-receiving portions 9 so that the pull 3 cannot be moved further. Further, because there is always a gap between the grip portion 38 of the pull 3 and the bent portion 31 of the sheet-like spring 2 located within the concave portion 41, plastic deformation never occurs in the bent portion 31 as it has been in a conventional case. Further, it is permissible to provide a gap between the bent portion 31 of the spring portion 31 and a top end of the guide post 7 so as to allow the bent portion 31 to be deformed plastically with a sufficient room.

(Modified Example)

FIGS. 5 to 8 show a modified example of the slider having the locking device in which the shapes of the slider and the pull 3 are different from the above-described slider. In this modified example, the configurations of the body 1 and the sheet-like spring 2 are the same. The pull 3 is provided with an axle 37 with which a cam 39 eccentric downward is formed integrally, at an end thereof while a grip portion 38 is formed on the other end. A through hole 40, of which side toward the grip portion 38 is circular, is provided between the axle 37 and the grip portion 38. The through hole 40 is formed such that it is be capable of avoiding the bent portion 31 of the spring portion 30 of the sheet-like spring 2 disposed on the top face of the guide post 7 when the pull 3 is disposed on the body 1 and laid to the side of the front end thereof. There is formed a gap between the grip portion 38 and the bent portion 31 when the pull 3 is disposed on the body 1 and laid to the side of the front end thereof.

Assembly of the slider is carried out in the same manner as the slider of the above-described embodiment. First, the pull 3 is mounted such that the cam 39 of the pull 3 is placed between the spring-receiving portions 9 and the guide portion 10 in a state that the cam 39 of the pull 3 is directed downward and the pull 3 is laid to the side of the rear end. When the sheet-like spring 2 is mounted on a top face of the pull 3, the protruded portions 29 are disposed below the spring-receiving portions 9 such that the base plate 27 of the sheet-like spring 2 covers the axle 37. Further, the engaging hole 28 of the sheet-like spring 2 holds the engaging portion 11 of the guide portion 10 and at the same time, the drooping portion 26 of the spring portion 30 is inserted into the accommodation groove 14 formed at the front face of the guide post 7 and fixed thereto.

Figure 6:
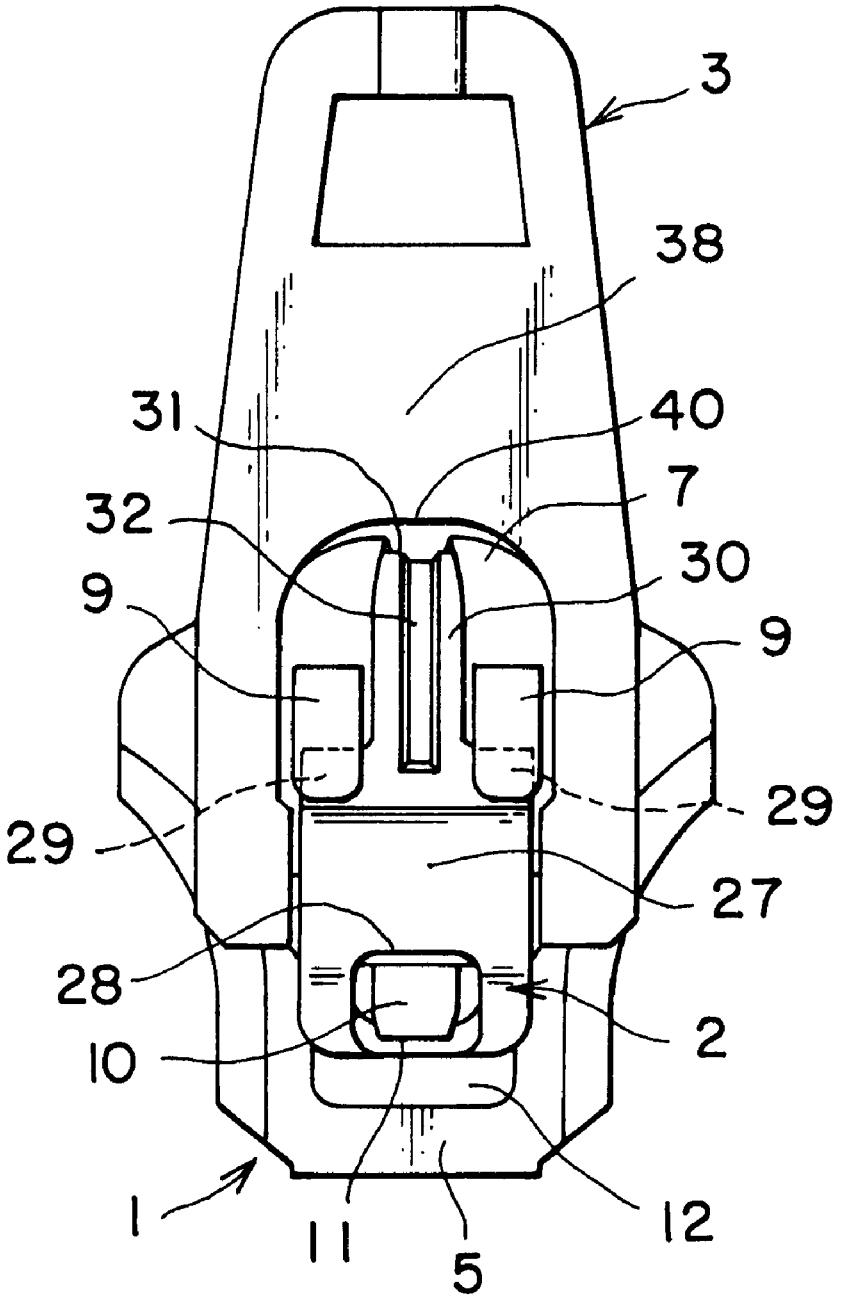
FIG. 6 is a front view showing a state in which the pull of the modified example is laid forward.
Figure 7:
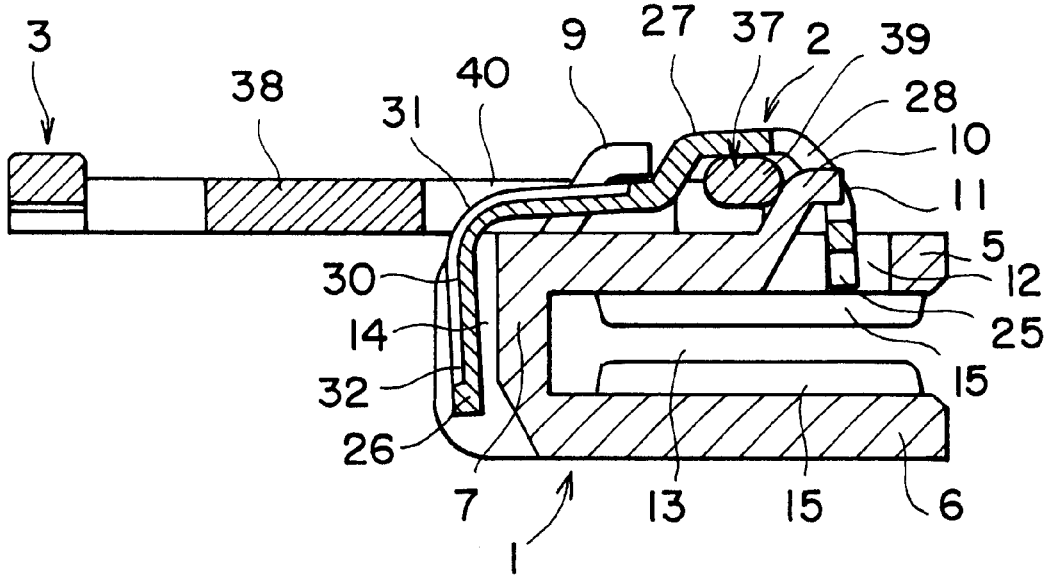
FIG. 7 is a longitudinal sectional view showing a state in which the pull of the modified example is laid forward.
Figure 8:
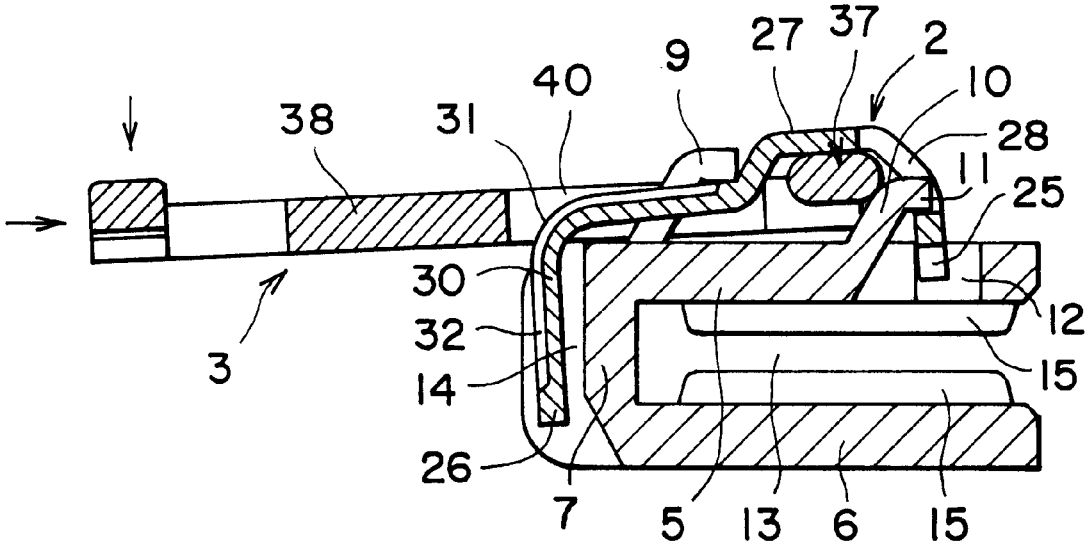
FIG. 8 is a longitudinal sectional view showing a state in which the pull of the modified example is laid forward and the load is applied.

In the assembled slider as shown in FIGS. 6 and 7, when the pull 3 is laid to the side of the front end of the body 1, there exists a gap between a circular edge of the opening in the grip portion 38 of the pull 3 and the bent portion 31 of the spring portion 30 of the sheet-like spring 2. If a load is applied to the laid pull 3 in the horizontal direction or in the vertical direction as shown in FIG. 8, the axle 37 of the pull 3 slides along the guide portion 10 so as to push up the base plate 27 of the sheet-like spring 2. At this time, the engaging hole 28 in the sheet-like spring 2 comes into contact with the engaging portion 11 of the guide portion 10, thereby blocking the locking pawl 25 from being raised further. When the locking pawl 25 is located at its rising limit position, there exists a gap between the grip portion 38 of the pull 3 and the bent portion 31 of the sheet-like spring 2, so that the grip portion 38 never contacts the bent portion 31 to press the bent portion 31, thereby making it possible to block the bent portion 31 from being plastically deformed. Further, when the load applied to the pull 3 is released, the sheet-like spring 2 can be elastically restored to its original state quickly. Namely, the sheet-like spring 2 may be elastically deformed in an effective manner for a long period.

(Second Embodiment)

Figure 9:
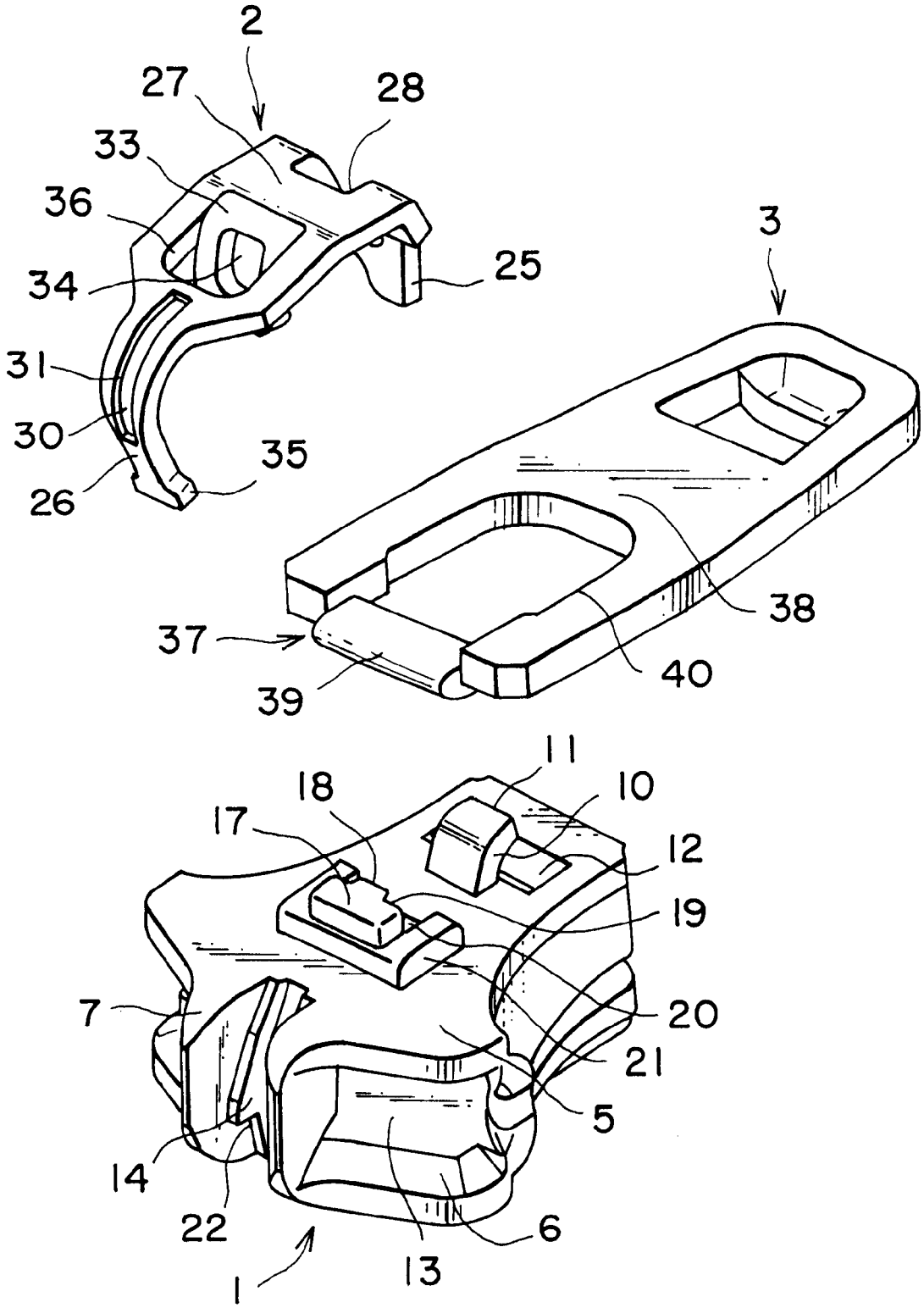
FIG. 9 is an exploded perspective view of a slider for slide fastener with locking device according to another embodiment.
Figure 10:
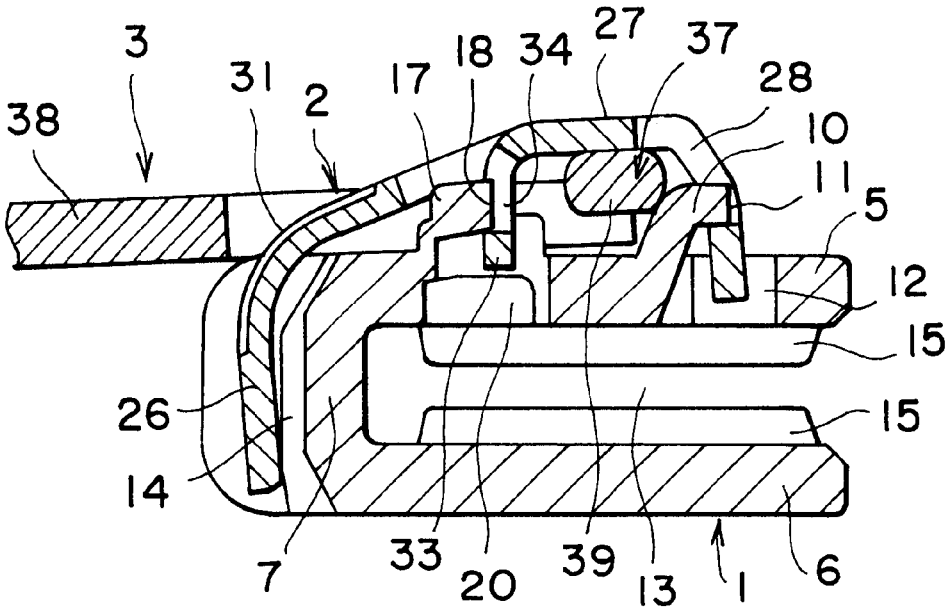
FIG. 10 is a longitudinal sectional view showing a state in which the pull of the slider is laid backward.
Figure 11:
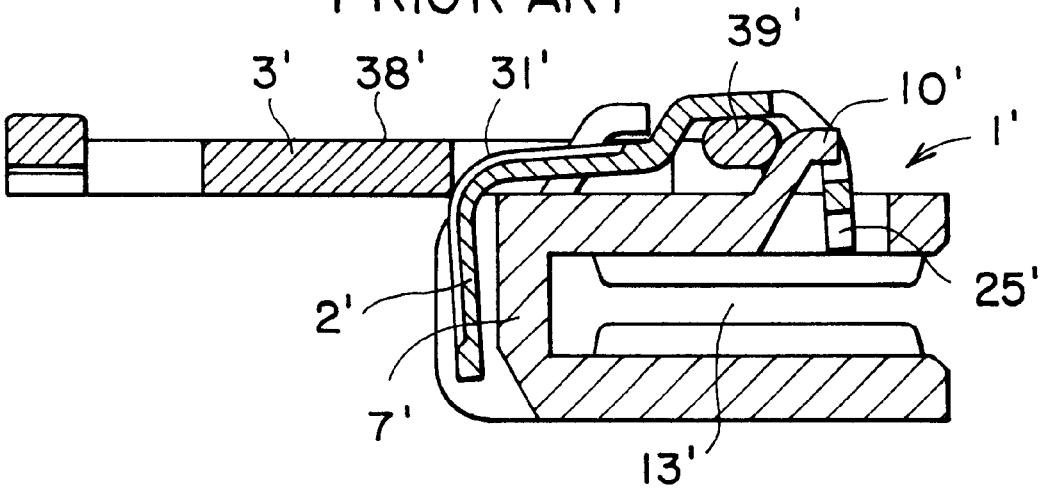
FIG. 11 PRIOR ART
FIG. 11 is a longitudinal sectional view showing a state in which a pull of a conventional slider with locking device is laid forward.
Figure 12:
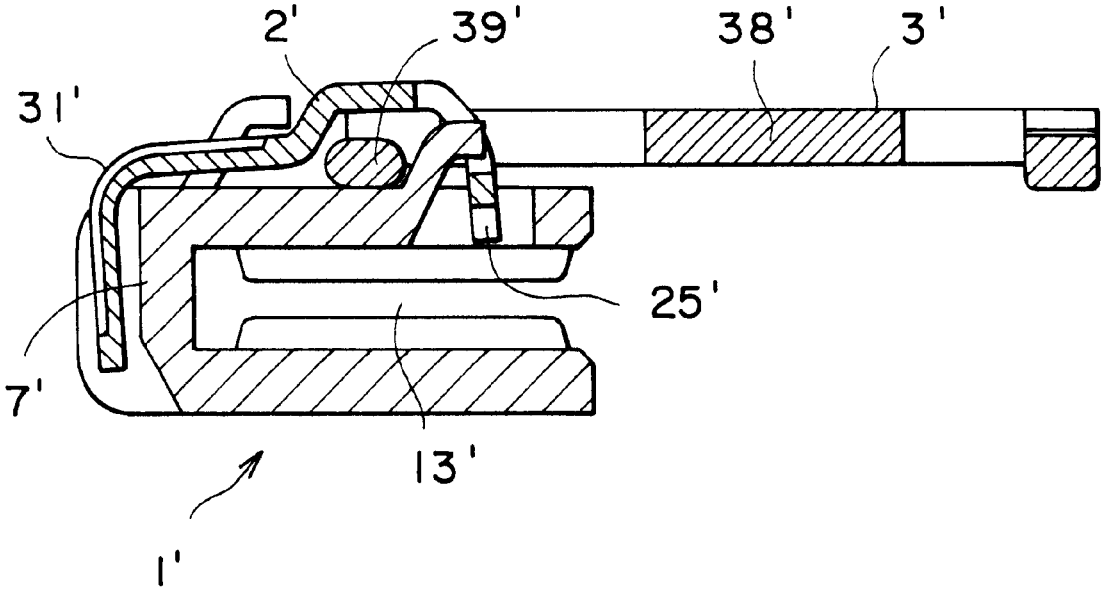
FIG. 12 PRIOR ART
FIG. 12 is a longitudinal sectional view showing a state in which a spring of the slider is deformed plastically.

FIGS. 9 and 10 show another embodiment of a slider with locking device. According to this embodiment, a hook-shaped protruded portion 17 is provided in a center of a shoulder portion or a front end of an upper wing plate 5 of a body 1. This protruded portion 17 has an engaging protrusion 18 protruded horizontally from a center of a front end thereof such that it can invade into a hole portion 34 provided in a engaging tongue portion 33 of a sheet-like spring 2. Contact portions 19, which can make contact with the engaging tongue piece 33 of the sheet-like spring 2, are formed on both sides of the engaging protrusion 18 at the front end of the protruded portion 17. These contact portions 19 are formed to be vertical planes relative to a top face of the upper wing plate 5. A through hole 20, which communicates with an element guide groove 13, is formed at a base portion of the protruded portion 17. A supporting base 21 for supporting a forwardly-inclined sheet-like spring 2 is provided on both sides of the base portion of the protruded portion 17.

A guide portion 10 is provided protrudedly on a center of a rear opening or a rear end of the upper wing plate 5 such that it is inclined backward. A front end of the guide portion 10 is bent to form an engaging portion 11, so that it can loosely engage an engaging hole 28 of the sheet-like spring 2. A pawl hole 12, which leads to the element guide groove 13, is provided at the base portion of the guide portion 10. Further, an accommodation groove 14, which is capable of accommodating a drooping portion 26 of a spring portion 30 of the sheet-like spring 2, is provided at a front face of a guide post 7. Substantially right-triangle-shaped engaging portions 22, each of which has a horizontal bottom while it has an inclined top, are provided on both sides of the accommodation groove 14, such that they can engage a protruded portion 35 protruded to both sides at a front end of the drooping portion 26 of the spring portion 30 of the sheet-like spring 2.

The sheet-like spring 2 is formed in a substantially inverted U shape and has a locking pawl 25 at one end thereof while it has a narrow drooping portion 26 at the other end thereof. The protruded portion 35 is provided at a front end of the drooping portion 26 such that it is protruded to both sides thereof so that it engages the engaging portion 22 of the guide post 7. An opening 36 is provided in a central base plate 27 of the sheet-like spring 2. The engaging tongue piece 33 is provided such that it is extended forward from the opening edge of the opening 36 and bent downward. A hole portion 34 is provided in the center of the holding tongue piece 33 so that the engaging protrusion 18 of the protruded portion 17 is capable of loosely engaging the hole portion 34. An engaging hole 28 is provided near the locking pawl 25 of the sheet-like spring 2 so that the engaging portion 11 of the guide portion 10 located at the rear end is capable of loosely engaging the engaging hole 28, thereby restricting the locking pawl 25 from being raised.

The pull 3 has an axle 37 at one end thereof while it has a grip portion 38 at the other end. A through hole 40 is provided between the axle 37 and the grip portion 38 such that its edge at the side of the grip portion 38 is circular. The through hole 40 is formed such that it can avoid the bent portion 31 of the spring portion 30 of the sheet-like spring 2 placed on a top face of the guide post 7 when the pull 3 disposed on the body 1 is laid to the side of the front end. Consequently, there always exists a gap between the grip portion 38 and the bent portion 31 so as not to block the motion of the spring portion 30.

Assembly of the slider is carried out in the same manner as the sliders of the above-described respective embodiments. First, the pull 3 is mounted such that the cam 39 of the pull 3 is placed between the spring-receiving portions 9 and the guide portion 10 in a state that the cam 39 of the pull 3 is directed downward and the pull 3 is laid to the side of the rear end. Then the sheet-like spring 2 is mounted on a top face of the pull 3. At this time, the locking pawl 25 is inserted into the pawl hole 12 in the upper wing plate 5 as shown in FIG. 10, while the engaging hole 28 loosely engages the guide portion 10, so that an opening edge of the engaging hole 28 can be held by the engaging portion 11.

Further the protruded portion 17 is inserted into the opening 36 provided in front of the base plate 27 of the sheet-like spring 2 and at the same time, the engaging tongue piece 33 is inserted into the through hole 20 provided under the protruded portion 17, such that the engaging protrusion 18 existing in the center of the front end of the protruded portion 17 engages the hole portion 34 of the engaging tongue piece 33. The side edges of the sheet-like spring 2 are mounted on the supporting base 21 provided on the upper wing plate 5 so that the surface of the engaging tongue piece 33 is pressed against the contact portion 19 provided on the protruded portion 17.

Furthermore, the protruded portion 35 provided at both sides of the front end of the drooping portion 26 of the spring portion 30 provided on a front end of the sheet-like spring 2 is pressed down along the slopes on both sides of the accommodating groove 14 provided in the guide post 7 so that the protruded portion 35 engage the engaging portions 22 to be fixed thereto. Thus, the slider can be assembled. In addition, there exists a gap between the bent portion 31 of the spring portion 30 of the mounted sheet-like spring 2 and the accommodation groove 14 in the guide post 7, so that this gap allows the spring portion 30 to be elastically deformed easily.

Therefore, in the assembled slider, even if a load is applied to the pull 3 in the horizontal direction or in the vertical direction with the pull 3 being laid to the side of the front end of the body 1, the axle 37 of the pull 3 slides along the guide portion 10 so as to push up the base plate 27 of the sheet-like spring 2, so that the locking pawl 25 is raised from the element guide groove 13. However, at this time, because there exists a gap between the grip portion 38 of the pull 3 and the bent portion 31 of the spring portion 30 of the sheet-like spring 2, the pull 3 never presses the spring portion 30. As a result, plastic deformation never occurs in the spring portion 30. Further, engagement between the engaging portion 11 of the guide portion 10 and the engaging hole 28 of the sheet-like spring 2 can block the sheet-like spring 2 from being raised excessively.

The respective embodiments of the slider having the locking device have been described. Although in these respective embodiments, the pull has an axle with an eccentric cam formed integrally, it is permissible to employ such a pull in which an axle thereof is disposed in the same plane as the grip portion.

As is apparent from the above description, the present invention exerts effects as follows.

In the slider with a locking device comprised of a body 1 with an element guide groove 13, which is formed by connecting an upper wing plate 5 having a pawl hole 12 with a lower wing plate 6 via a guide post 7, a sheet-like spring 2 mounted on the upper wing plate 5 and having a bending locking pawl 25 at one end thereof, and a pull 3 having a grip portion 38 at one end thereof and an axle 37 having a cam 39 at the other end such that the axle 37 is disposed between the upper wing plate 5 and the sheet-like spring 2, wherein when the pull 3 pivoted on the upper wing plate 5 is laid forward of the slider body 1 and a pressure is applied, there exists a gap between the sheet-like spring 2 exposed at the guide post 7 and the grip portion 38. Therefore, even when the pull 3 is laid forward and then a load is applied, the sheet-like spring 2, which is exposed in the same manner as the conventional ones, is never plastically deformed by the pull 3. Thus, the slider with locking device is never damaged under any use condition and can exert its locking function effectively.

Further, the sheet-like spring 2 has a bent portion 31 of a spring portion 30 bent in the same direction as the locking pawl 25, at an exposed part of the guide post 7. Therefore, the exposed part of the guide post 7 is the bent portion 31 of the sheet-like spring 2. Thus, the bent portion 31 in which the elastic deformation occurs most excessively in the sheet-like spring 2 can be protected so that the sheet-like spring 2 can be allowed to be elastically deformed effectively for a long period.

Furthermore, because a gap is provided between the bent portion 31 and the guide post 7 so that the sheet-like spring 2 is allowed to be elastically deformed, the gap existing between the bent portion 31 and the guide post 7 allows the bent portion 31 to keep its elastic deformation with a sufficient room.

Still further, because the pull 3 has an inverted-T shaped through hole 40 in which its side toward the axle 37 is expanded, a dented portion 41 of the through hole 40 avoids the sheet-like spring 2 when the pull 3 is laid forward and a pressure is applied, and an expanded portion 42 is capable of making contact with a spring-receiving portions 9 provided on a top face of the body 1, the through hole 40 is capable of avoiding the bent portion 31 of the sheet-like spring 2 effectively. Additionally, because the expanded portion 42 makes contact with the spring-receiving portion 9, even if an excessive load is applied to the pull 3, the elasticity of the sheet-like spring 2 can be protected from any influence.

Still further, the pull 3 has a through hole 40 in which its side toward the grip portion 38 is circular, when the pull 3 is laid forward and a pressure is applied, a circular edge of the through hole 40 avoids the sheet-like spring 2. Consequently, even if the through hole 40 avoids the bent portion 31 so that the pull 3 is deviated slightly to the right or the left for example, the bent portion 31 of the sheet-like spring 2 is protected from any influence.

Still further, the sheet-like spring 2 has an engaging hole 28 for engaging with a guide portion 10 provided so as to be inclined on a top face of the body 1 above the locking pawl 25, and when the pull 3 is laid forward and a pressure is applied, the engaging hole 28 engage an engaging portion 11 bent at a front end of the guide portion 10, thereby blocking the locking pawl 25 from being raised. Consequently, even if a load is applied to the pull 3 in the horizontal direction or the vertical direction, so that the axle 37 of the pull 3 raises the sheet-like spring 2 up to the rising limit position of the locking pawl 25, the grip portion 38 of the pull 3 never contacts the bent portion 31 to apply a pressure. Therefore, an effective locking function is ensured for a long period. Thus, the effects which the present invention achieves are very remarkable.

DESCRIPTION OF REFERENCE NUMERAL

1: Body
2: Sheet-like spring
3: Pull
5: Upper wing plate
6: Lower wing plate
7: Guide post
9: Spring-receiving portion
10: Guide portion
12: Pawl hole
13: Element guide groove
25: Locking pawl
28: Engaging hole
30: Spring portion
31: Bent portion
37: Axle
38: Grip portion
39: Cam
40: Through hole
41: Concave portion
42: Expanded portion

What is claimed:

1. A slider for slide fastener with locking device comprised of a body with an element guide groove, which is formed by connecting an upper wing plate having a pawl hole with a lower wing plate via a guide post, a sheet-like spring mounted on the upper wing plate and having a bending locking pawl at one end thereof, and a pull having a grip portion at one end thereof and an axle having a cam at the other end such that the axle is disposed between the upper wing plate and the sheet-like spring, wherein when the pull, which is capable of pivoting with respect to the upper wing plate, is laid forward of the slider body, a gap exists between the sheet-like spring exposed at the guide post and the grip portion, wherein said sheet-like spring has a spring portion having a bent portion that is bent in the same direction as the locking pawl, at an exposed part of the guide post, and wherein a gap is provided between the bent portion and the guide post so that the sheet-like spring is capable of being elastically deformed in the gap.

2. The slider for slide fastener with locking device according to claim 1, wherein the pull has an inverted-T shaped through hole in which its side toward the axle is expanded, a dented portion of the through hole avoids the sheet-like spring when the pull is laid forward and a pressure is applied, and an expanded portion is capable of making contact with a spring-receiving portion provided on a top face of the body.

3. The slider for slide fastener with locking device according to claim 1, wherein the pull has a through hole in which its side toward the grip portion is circular and when the pull is laid forward and a pressure is applied, a circular edge of the through hole avoids the sheet-like spring.

4. The slider for slide fastener with locking device according to claim 1, wherein the sheet-like spring has an engaging hole for engaging with a guide portion provided so as to be inclined on a top face of the body above the locking pawl, and when the pull is laid forward and a pressure is applied, the engaging hole engages an engaging portion bent at a front end of the guide portion, thereby blocking the locking pawl from being raised.

* * * * *